United States Patent [19]

Rodda

[11] 4,113,376

[45] Sep. 12, 1978

[54] CLEANING APPARATUS FOR REPRODUCING MACHINE

[75] Inventor: John C. Rodda, Webster, N.Y.

[73] Assignee: Xerox Corporation, Stamford, Conn.

[21] Appl. No.: 800,581

[22] Filed: May 25, 1977

[51] Int. Cl.[2] ..... G03G 21/00

[52] U.S. Cl. ..... 355/15; 15/256.52; 15/308

[58] Field of Search ..... 355/15; 101/425; 15/308, 256.52, 230, 312; 118/652

[56] References Cited

U.S. PATENT DOCUMENTS

| | | | |
|---|---|---|---|
| 3,217,646 | 11/1965 | Sharkey | 355/15 X |
| 3,819,263 | 6/1974 | Draugelis et al. | 355/15 X |

*Primary Examiner*—Richard L. Moses

[57] ABSTRACT

An improved cleaning apparatus adapted for use in removing residual material such as toner from an imaging surface of a reproducing machine. A cleaning element is supported for rotation about a given axis and a housing is arranged about the cleaning element. A vacuum air flow is created through the housing and about the element in order to collect the residual material removed. The vacuum port is arranged at one side of the housing. A baffle reduces the asymmetric variation in air flow caused by the presence of the vacuum port at one side of the housing. The baffle comprises a plate-like member which extends parallel to the axis of the cleaning element and is inclined away from the cleaning element transversely of the axis.

14 Claims, 4 Drawing Figures

CLEANING APPARATUS FOR REPRODUCING MACHINE

BACKGROUND OF THE INVENTION

This invention relates to an improved cleaning apparatus adapted for use in removing residual material such as toner from an imaging surface of a reproducing machine. A reproducing machine employing the cleaning apparatus also forms part of this invention.

PRIOR ART STATEMENT

It is well known in the reproducing art to employ rotary brush cleaners for removing residual material from an imaging surface. U.S. Pat. No. 3,278,972, to Hudson is illustrative of such a prior art cleaner. The cleaning apparatus as described in that patent includes a rotary brush which engages a photoreceptor surface to remove residual toner particles from the surface. The brush is supported within a housing and a vacuum air flow is created in the housing and about the brush by means of a suction fan connected thereto. The vacuum air flow serves to remove the particles of residual material from the brush fibers and carry them away for collection by a filtering mechanism or separating type device.

Generally the vacuum air flow is created in the brush cleaner housing by drawing the air through a port located centrally in the axial sense of the brush. It has been found desirable in some cases, particularly to achieve a compact arrangement, to locate the vacuum air flow port at an end of the housing. This results in an ssymmetric variation in the air flow within the housing so that the pressure and velocity distribution of the air flow varies from one side of the housing to the other.

U.S. Pat. No. 3,217,646 to Sharkey illustrates a cleaning apparatus wherein a rotating cleaning brush is supported by a housing for removing dusting powder from printing sheets as they are started on an impression cylinder. In this system a discharge port is located at a side of the housing. In order to facilitate discharge of the dust through the port, a baffle, which comprises a plate-like member, extends longitudinally of the interior of the housing and slopes outwardly from the brush to the discharge port.

SUMMARY OF THE INVENTION

In accordance with the present invention a cleaning apparatus for removing residual material from an imaging surface is provided which comprises a rotary cleaning element for removing the residual material. The cleaning element is arranged for rotation about a given axis. A housing supports the cleaning element and means are provided for creating a vacuum air flow through the housing and about the brush in order to collect the residual material removed by the cleaning element. The vacuum air flow providing means includes a vacuum port arranged at one side of the housing which would cause an asymmetric variation in the pressure and velocity of the air flow in the housing from one end of the cleaning element to the other. A baffle is provided for reducing this asymmetric variation in the air flow. In accordance with the present invention the baffle is formed of a plate-like member which extends parallel to the axis of the cleaning element and is inclined away from the cleaning element transversely of the axis.

The cleaning element preferably comprises a brush cleaning element. However, the system of the present invention is useful with other types of cleaning elements including fabric rollers and foam rolls.

Preferably the baffle extends axially within the housing over less than the distance between the sides of the housing and is positioned closer to the vacuum port side of the housing. The baffle is preferably spaced from both sides of the housing although it is spaced to a lesser extent from the side of the housing adjacent the vacuum port.

The baffle of this invention provides a marked reduction in the variation in the static pressure and velocity of the vacuum air flow across the cleaning element.

A reproducing machine in accordance with the present invention preferably includes an imaging surface; means for forming an electrostatic image on the surface; means for developing the image to render it visible; means for transferring the image to a sheet of final support material; and the cleaning apparatus in accordance with this invention for removing residual material from the imaging surface.

Accordingly, it is an object of this invention to provide an improved cleaning apparatus particularly adapted for use in a reproducing machine.

It is a further object of this invention to provide an apparatus as above including means for providing a more generally uniform distribution of a vacuum air flow about the cleaning element.

It is a still further object of this invention to provide an improved reproducing apparatus employing the cleaning apparatus as above.

These and other objects will become more apparent from the following description and drawings.

DETAILED DESCRIPTION OF THE PREFERRED EMBODIMENTS

Figure 1:
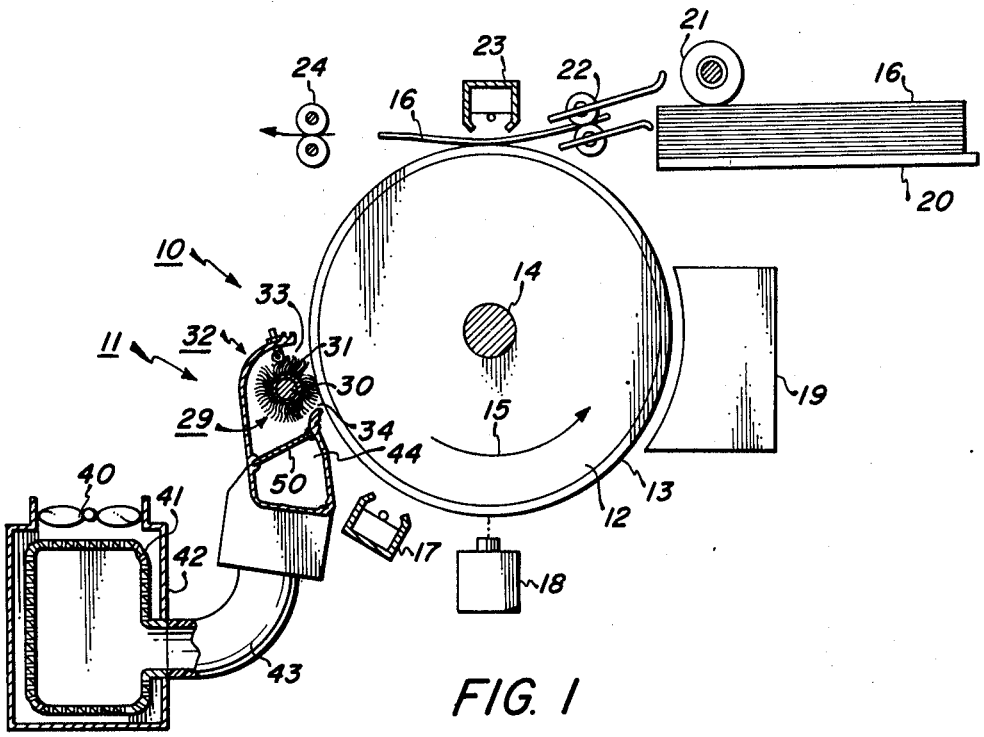
FIG. 1 is a schematic representation of a reproducing apparatus in accordance with the present invention.

Referring now to FIG. 1 there is shown by way of example an automatic xerographic reproducing machine 10 which includes the cleaning apparatus 11 of the present invention. The reproducing machine 10 depicted in FIG. 1 illustrates the various components utilized therein for producing copies from an original. Although the cleaning apparatus 11 of the present invention is particularly well adapted for use in an automatic xerographic reproducing machine 10, it should become evident from the following description that it is equally well suited for use in a wide variety of processing systems including other electrostatographic systems and it is not necessarily limited in its application to the particular embodiment or embodiments shown herein.

The reproducing machine 10 illustrated in FIG. 1 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

The practice of xerography is well known in the art and is the subject of numerous patents and texts including *Electrophotography* by Schaffert, and *Xerography and Related Processes* by Dessauer and Clark, both published in 1965 by the Focal Press.

Initially, the drum 12 moves the photoconductive surface 13 through a charging station 17. In the charging station 17, an electrostatic charge is placed uniformly over the photoconductive surface 13 preparatory to imaging. The charging may be provided by a corona generating device.

Thereafter, the drum 12 is rotated to exposure station 18 wherein the charged photoconductive surface 13 is exposed to a light image of the original input scene information whereby the charge is selectively dissipated in the light exposed regions to record the original input scene in the form of a latent electrostatic image. After exposure drum 12 rotates the electrostatic latent image recorded on the photoconductive surface 13 to development station 19 wherein a conventional developer mix is applied to the photoconductive surface 13 of the drum 12 rendering the latent image visible. A suitable developer station comprises a magnetic brush development system utilizing a magnetizable developer mix having coarse ferromagnetic carrier granules and toner colorant particles. The developer mix is brought through a directional flux field to form a brush thereof. The electrostatic latent image recorded on the photoconductive surface 13 is developed by bringing the brush of developer mix into contact therewith.

Sheets 16 of the final support material are supported in a stack arrangement 20. A sheet separator 21 feeds individual sheets from the stack to a registration system 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. The final support material may be paper, plastic, etc., as desired.

After the toner image has been transferred to the sheet of final support material 16 the sheet with the image thereon is advanced to a suitable fuser 24 which coalesces the transferred powder image thereto. After the fusing process the sheet 16 is advanced to a suitable output device (not shown).

Although a preponderance of the toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning apparatus 11 of this invention.

It is believed that the foregoing description is sufficient for purposes of the present application to illustrate the general operation of an automatic xerographic copier 10 which can embody the cleaning apparatus 11 in accordance with the present invention.

Referring now to FIGS. 1 through 4, the improved cleaning apparatus of this invention will be described in greater detail. The cleaning element 29 preferably comprises a brush with a core 30 having a plurality of fibers 31 extending radially outwardly therefrom. The brush 29 sweepingly engages the photoreceptor surface 13 to remove the residual toner particles. The brush fibers may be formed of any desired material in accordance with prior art practice as described in the above-noted Hudson patent. Alternatively, any well known type of cleaning element can be employed including a foam roller as in U.S. Pat. No. 3,807,853 to Hudson.

The brush 29 is supported to rotate counter to the imaging surface, within a brush cleaner housing 32 which surrounds the brush except for an opening adjacent the imaging surface 13 which allows communication between the brush and that surface. The brush entrance gap 33 between the upper portion of the housing 32 and the brush 29 is deliberately made wider than the brush exit gap 34 between the lower portion of the housing brush. The brush fibers 31 enter the housing 32 at the entrance gap 33 amd exit the housing at the exit gap 34. The gap 35 between the upper lip of the housing 32 and the imaging surface 13 is greater than the gap 36 between the lower lip of the housing and the imaging surface. The effect of these relative gap spacings is that the major portion of the air flow occurs through the entrance gap.

A flicker bar 37 is arranged axially parallel to the brush 29 from one end of the housing 32 to the other and serves in accordance with prior art practice to flick the brush fibers 31 as the brush rotates in order to improve the separation of the toner particles from the brush fibers. A vacuum air flow is provided by means of a blower fan 40 which communicates with filter 41 in filter box 42. The filter box 42 is connected via a conduit 43 to the manifold 44 defined by the brush cleaner housing 32.

Approximately 70% of the vacuum air flow into the housing 32 occurs through the brush entrance gap 33 and approximately 20% of the vacuum air flow occurs through the brush exit gap 34. The remaining air flow into the housing is from its ends. Therefore, the vast majority of the air flow occurs at the input side of the housing 32 adjacent the flicker bar 37. The flicker bar 37 is located close to the imaging surface 13 so that the residual toner particles adhering to the brush fibers are operated upon quickly after their removal from the imaging surface. This provides improved cleaning and a reduced tendency toner filming.

Figure 4:
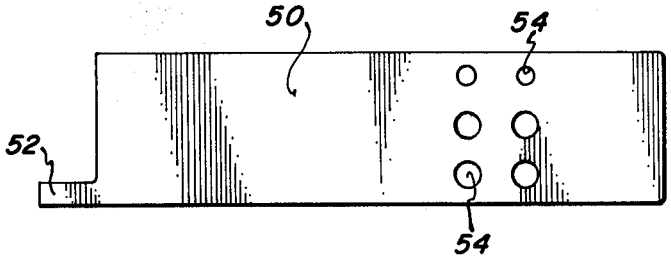
FIG. 4 is a top view of a vacuum air flow baffle in accordance with this invention.

In order to provide an extremely compact brush cleaner housing and vacuum manifold, the vacuum port 50 in the housing 32 is located to one side thereof. In the preferred embodiment shown, the vacuum port 50 is located at one end of the housing. This results in an asymmetric air flow pattern about the brush 29 which would impare its cleaning ability. In accordance with this invention, to correct this asymmetric variation in the pressure and air flow about the brush 29 from one side of the housing to the other, a baffle 50 is provided which substantially reduces the variation. The baffle 50, as shown in FIG. 4, comprises a plate-like member.

Figure 2:
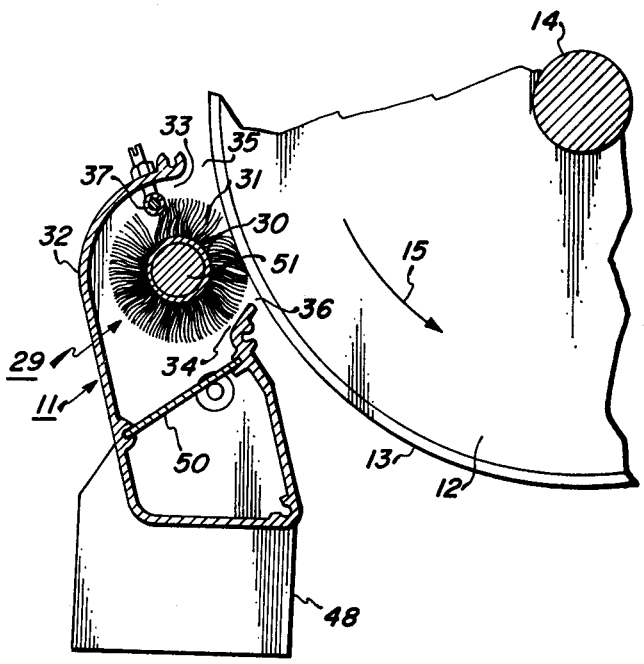
FIG. 2 is an enlarged side view in cross-section of a cleaning apparatus in accordance with this invention.
Figure 3:
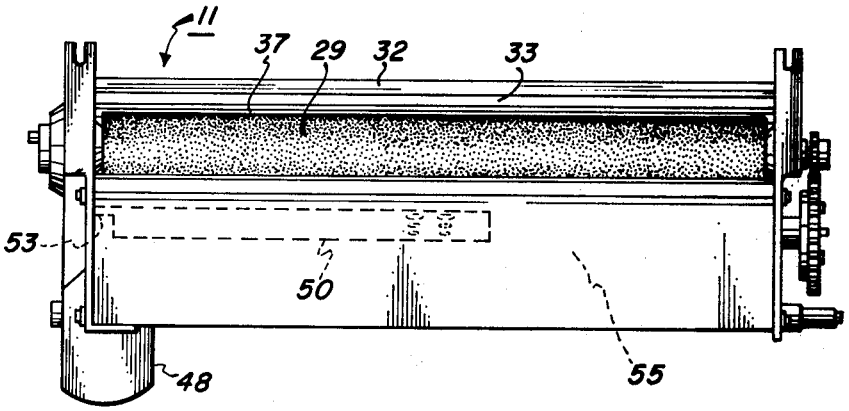
FIG. 3 is a front view of the cleaning apparatus in accordance with the present invention.

As shown in FIGS. 2 and 3, the baffle 50 extends parallel to the axis 51 of the brush 29. The baffle 50 is inclined away from the brush 29 transversely of the brush axis 51. In the embodiment shown the baffle 50 extends rearwardly and downwardly of the brush 29. Therefore, in accordance with this invention the term "rearwardly and downwardly" which defines the orientation of the baffle 50 in the disclosed embodiment refers to a direction extending outwardly of the imaging surface 13 and outwardly of the brush 29.

This inclination of the baffle 50 with respect to the brush 29 represents a significant improvement. It is operative to reduce the collection of toner particles on the baffle 50 as well as to reduce the impedance or restriction of the air flow caused by the baffle.

These results are believed to be achieved in part by a streamlining of the air flow about the baffle 50. The baffle 50 of the present invention provides substantial improvement in the uniformity of the air flow distribution and pressure distribution about the brush 29 with only a 7% loss in air flow (impedance) as compared to a housing without any baffle. This represents a marked improvement in the efficiency of the baffle.

The baffle of the present invention is shown in greater detail in FIG. 4. It comprises a plate-like member as described above. At one end a tab 52 is provided which serves to space the plate-like member from the vacuum port 48 side of the housing 32. Therefore, an air flow opening 53 as in FIG. 3, is provided by the space between the baffle 50 and the side of the housing adjacent the port 48.

The baffle 50 does not extend completely from one end of the housing 32 to the other. In fact, it has been found desirable to limit the length of the baffle to less than about 75% of the distance between the sides of the housing. A baffle 50 which extends about 55% of the distance between the ends of the housing has been found to be particularly effective.

In order to further reduce the impedance or air flow restriction of the baffle 50, in accordance with this invention, a plurality of holes 54 are located in the baffle to allow air to flow intermediate the ends of the baffle. The total surface area of those holes comprises less than about 5% of the surface area of the baffle. If desired, a single hole 54 having the same total surface area could be employed. An intermediate hole or port 54 in the baffle comprising about 3.5% of the surface area of the baffle has been found to be effective. The intermediate baffle port or ports 54 are preferably located at a position away from the port 48 about two-thirds to three-fourths of the length of the baffle.

The air flow slot 53 defined by the gap between the baffle 50 and the side of the housing 32 adjacent the port 48 is comparatively narrow. For a particularly preferred embodiment it is approximately about ½ inch or less. The air flow slot or gap 55 between the other end of the baffle 50 and the other end of the housing 32 is substantially larger. For a particularly preferred embodiment wherein the internal distance between the sides of the housing is about 15½ inches and wherein the brush is about 14¼ inches long, the far end slot 55 comprises about 6½ inches and the baffle is about 8½ inches long with a tab 52 about ½ inch long.

While the cleaner housing 32 is shown in a generally vertical orientation at a side of the drum 12, it may be positioned anywhere about the drum periphery as the architecture of the machine dictates.

When one inserts the baffle into the vacuum chamber 44 there is a resistance or impedance to air flow created which of necessity increases the power required to generate a sufficient air flow in the system to provide adequate cleaning of the cleaning element. It has been found in accordance with the present invention that this impedance loss may be substantially reduced by employing a baffle of the configuration as described above.

Preferably, in accordance with this invention, the baffle is planar. Preferably the baffle is adapted to balance the static pressure variation across the housing 32 in the vicinity of the brush 29 so that the variation is less than about ± 0.05 inches water gauge of static pressure.

The texts, patents and patent applications set forth above are intended to be incorporated by reference into this application.

It is apparent that there has been provided in accordance with this invention a cleaning apparatus and reproducing machine which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a cleaning apparatus for removing residual material from an imaging surface comprising:

a rotary cleaning means for removing said residual material, said cleaning means being arranged for rotation about a given axis; a housing for supporting said cleaning means; and means for providing a vacuum air flow through said housing and about said cleaning means in order to collect said residual material removed by said cleaning means, said vacuum air flow providing means including a vacuum port arranged adjacent one side of said housing which would create an asymmetric variation in the pressure and velocity of the air flow about said cleaning means from one side of said housing to an opposing side thereof; the improvement wherein said apparatus further comprises;

baffle means for reducing said asymmetrical distribution of said air flow, said baffle means comprising;

a plate member extending parallel to said axis of said cleaning means, said plate member being inclined away from said cleaning element transversely of said axis.

2. An apparatus as in claim 1, wherein said plate member is planar.

3. An apparatus as in claim 1, wherein said plate member extends axially over less than the entire distance between said sides of said housing and is positioned closer to said one side of said housing than to said opposing side thereof.

4. An apparatus as in claim 3, wherein said plate member is spaced from both said one side of said housing and said opposing side of said housing.

5. An apparatus as in claim 4, wherein said means for reducing said asymmetrical distribution of said air flow is adapted to balance the static pressure variation from said one side to said opposing side of said housing in the vicinity of said cleaning means so that said variation comprises no more than about ± 0.05 inches of water gauge of static pressure.

6. An apparatus as in claim 5, wherein said cleaning means comprises a brush.

7. An apparatus as in claim 6, wherein said baffle includes means for reducing its air flow impedance.

8. An apparatus as in claim 7, wherein said means for reducing the impedance of said baffle comprise at least one opening in said member to allow the passage of air through said member.

9. An apparatus as in claim 8, wherein the surface area of said opening is less than bout 5% of the surface area of said baffle.

10. An apparatus as in claim 9, wherein said at least one opening is arranged closer to an end of said baffle adjacent said opposing end of said housing than to an end of said baffle adjacent said one end of said housing.

11. An apparatus as in claim 10, wherein said at least one opening comprises a plurality of openings, and wherein the combined surface area of said plurality of openings is equal to the surface area of said at least one opening.

12. An apparatus as in claim 11, wherein said end of said baffle adjacent said one end of said housing is spaced from said end of said housing a distance of about ½ inch or less.

13. An apparatus as in claim 9, wherein said baffle has a length of less than about three-fourths of the distance between said ends of said housing.

14. An apparatus as in claim 1, which comprises part of a reproducing machine which further includes;

an imaging surface;

means for forming an electrostatic image on said surface;

means for developing said electrostratic image to render it visible; and means for transferring said developed image to a sheet of support material; the further improvement wherein, said baffle is inclined outwardly of said cleaning means and said imaging surface.

* * * * *